US006131996A

United States Patent [19]

Gebhard

[11] Patent Number: 6,131,996

[45] Date of Patent: Oct. 17, 2000

[54] SEAT CARRIER FOR CHAIRS

[75] Inventor: Reinhard Gebhard, Sulzbach-Rosenberg, Germany

[73] Assignee: Sifa Sitzfabrik GmbH, Germany

[21] Appl. No.: 09/324,496

[22] Filed: Jun. 2, 1999

Related U.S. Application Data

[63] Continuation of application No. PCT/DE98/02889, Sep. 30, 1998.

[30] Foreign Application Priority Data

Oct. 2, 1997 [DE] Germany ..... 297 17 571

[51] Int. Cl.[7] ..... A47C 1/02

[52] U.S. Cl. ..... 297/313; 297/302.4; 297/326; 248/372.1

[58] Field of Search ..... 297/326, 313, 297/344.15, 325, 302.4; 248/327.1

[56] References Cited

U.S. PATENT DOCUMENTS

| | | | |
|---|---|---|---|
| 4,752,101 | 6/1988 | Yurchenco et al. | 297/326 |
| 4,818,019 | 4/1989 | Mrotz, III | 297/326 X |
| 4,832,402 | 5/1989 | Zund | 297/326 X |
| 4,889,384 | 12/1989 | Sulzer | 297/326 |
| 4,915,449 | 4/1990 | Piretti | 297/326 |

FOREIGN PATENT DOCUMENTS

| | | |
|---|---|---|
| 0045925 | 8/1981 | European Pat. Off. . |
| 0198056 | 5/1986 | European Pat. Off. . |
| 1010628 | 3/1952 | France . |
| 2147072 | 4/1973 | Germany . |
| 2167947 | 6/1986 | United Kingdom . |
| 9722283 | 6/1997 | WIPO . |

*Primary Examiner*—Anthony D. Barfield
*Attorney, Agent, or Firm*—Morrison Law Firm

[57] ABSTRACT

A seat platform carrier for a chair tilts backward and forward relative to a base part when a load, such as a person sitting is the chair, is placed on the seat carrier. A resetting mechanism positioned the seat platform carrier to the same initial position when the load is removed. A lamellar pack attached to a hand lever provides the user with a means to lock the seat platform carrier in a desired tilted position. A height adjusting actuator is included in the base part to permit the user to select an appropriate seat platform height. A user sitting on the seat platform carrier is able to freely tilt forward or backwards.

12 Claims, 1 Drawing Sheet

SEAT CARRIER FOR CHAIRS

This application is a continuation of PCT/DE98/02889 filed Sep. 30, 1998, published as WO/99/17637 on Apr. 15, 1999.

BACKGROUND OF THE INVENTION

The present invention relates to a seat carrier for chairs. More specifically, the present invention relates to a seat carrier for chairs in which a seat platform carrier can tilt backward and forward against a base part. Even more specifically, the present invention relates to a seat carrier for chairs with resetting means for returning the seat platform carrier to its initial position when a load is removed.

A conventional seal carrier for chairs, in particular for office swivel chairs, has a base part with a U-shaped cross section. In the bottom of the base part is a conical bushing for receiving a height adjustable support column. A seat platform carrier is pivotably connect to the base part by a pin.

In EP-B-0 198 056, for example, the seat platform carrier is connected by a front pin to the front part of the base part. A compression spring is positioned between the base part and the seat platform carrier to push both parts apart. When the seat load is removed, the seat platform carrier and the base part always return to the same initial position unless a special clamping mechanism is activated. In this conventional seat carrier, the tilting movement of the seat platform carrier is substantially a backward movement.

OBJECTS AND SUMMARY OF THE INVENTION

It is an object of the present invention to provide a seat carrier for chairs in which the seat platform carrier can tilt backward and forward against the base part.

It is a further object of the present invention to provide a seat carrier for chairs having a resetting means for returning the seat platform carrier to the same initial position when a load is removed.

Briefly stated, the present invention provides seat platform carrier for a chair which tilts backward and forward relative to a base part when a load, such as a person sitting is the chair, is placed on the seat carrier. A resetting mechanism positioned the seat platform carrier to the same initial position when the load is removed. A lamellar pack attached to a hand lever provides the user with a means to lock the seat platform carrier in a desired tilted position. A height adjusting actuator is included in the base part to permit the user to select an appropriate seat platform height. A user sitting on the seat platform carrier is able to freely tilt forward or backwards.

According to an embodiment of the present invention, there is provided a seat carrier for a chair comprising: a base part; a seat platform carrier; connecting means for pivotably connecting the seat platform carrier to the base part, whereby the seat platform carrier can tilt forward and backwards relative to the base part; the connecting means including a pin horizontally transversing the base part located a prescribed length from a front end and a back end of thed base part; the prescribed distance being at least ¼ of a length of the seat platform carrier; and resetting means for returning the seat platform carrier from a tilting position, when a load is applied to the seat platform carrier, to an original initial position when the load is removed.

According to another embodiment of the present invention, there is provided a seat carrier for a chair comprising: a base part; a seat platform carrier; a pin horizontally transversing the base part located a prescribed length from a front end and a back end of the base part; the prescribed distance being at least ¼ of a length of the seat platform carrier; downward flaps located at opposite ends of the seat platform carrier partially overlapping side walls of the base part; the pin extending through the flaps and the side walls; a retaining pin extending substantially parallel to the pin attached at each end to the downward flaps; an aligning pawl extending diagonally in the base part attached at one end to the retaining pin; and a compression spring attached at one end to the base part and at the other end to the other end of the aligning pawl such that when a load is applied to the seat platform carrier, the compression spring provides a resilient force through the aligning pawl to the seat platform carrier.

A seat carrier of the present invention is characterized by a seat platform carrier that is pivotably arranged against the force of an elastic element by a load about a horizontal axis of the base part. The base part is positioned at a distance from both ends of the seat platform carrier by a prescribed distance, preferably a distance of at least ¼ of the length of the seat platform carrier. A resetting means returns the seat platform carrier from any tilting position to its initial position when a load is removed. The resetting means is activated by a restorative force of an elastic element.

According to a feature of the present invention, a pin connects the base part to the seat platform carrier. The pin is mounted in two flaps of the seat platform carrier at least partially overlapping the two side walls of the base part. The pin is led through holes in the two side walls of the base part. Spaces are present between the front end and the back end of the seat platform carrier. A retaining pin is arranged in the flaps of the seat platform carrier at a distance to the pin as well as parallel to the pin. The resetting means has an aligning pawl in the flaps of the seat platform carrier at a distance to the pin as well as parallel to the pin. The aligning pawl is pivotably arranged on the retaining bolt, pointing downward into the base part. The aligning pawl has an arched or V-shaped concave aligning link for a link pin held between the side walls of the base part. A compression spring, supported in the base part, applies pressure to the aligning pawl on the side away from the aligning link. Preferably, a lamellar stack, linked to the retaining pin, is slidably mounted on the other side of the retaining pin with oblong holes. The lamellar stack is mounted on a clamping pin between the side walls of the base part, allowing a relative tilting motion between the seat platform carrier and the base part. A clamping means, activated by a hand lever, is provided for the lamellar stack. Preferably, an actuator lever is pivotably mounted on the pin. The actuator lever for a gas spring connects to a handling means leading toward the outside of the base part.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
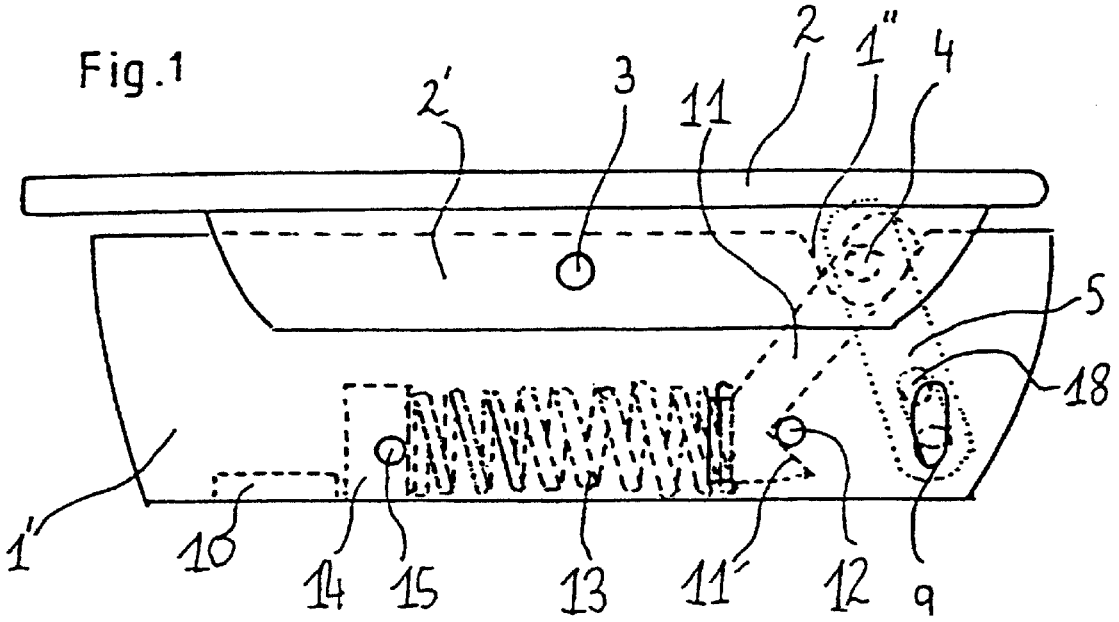
FIG. 1 is a partially cut-away side view of a seat carrier of the present invention.
Figure 2:
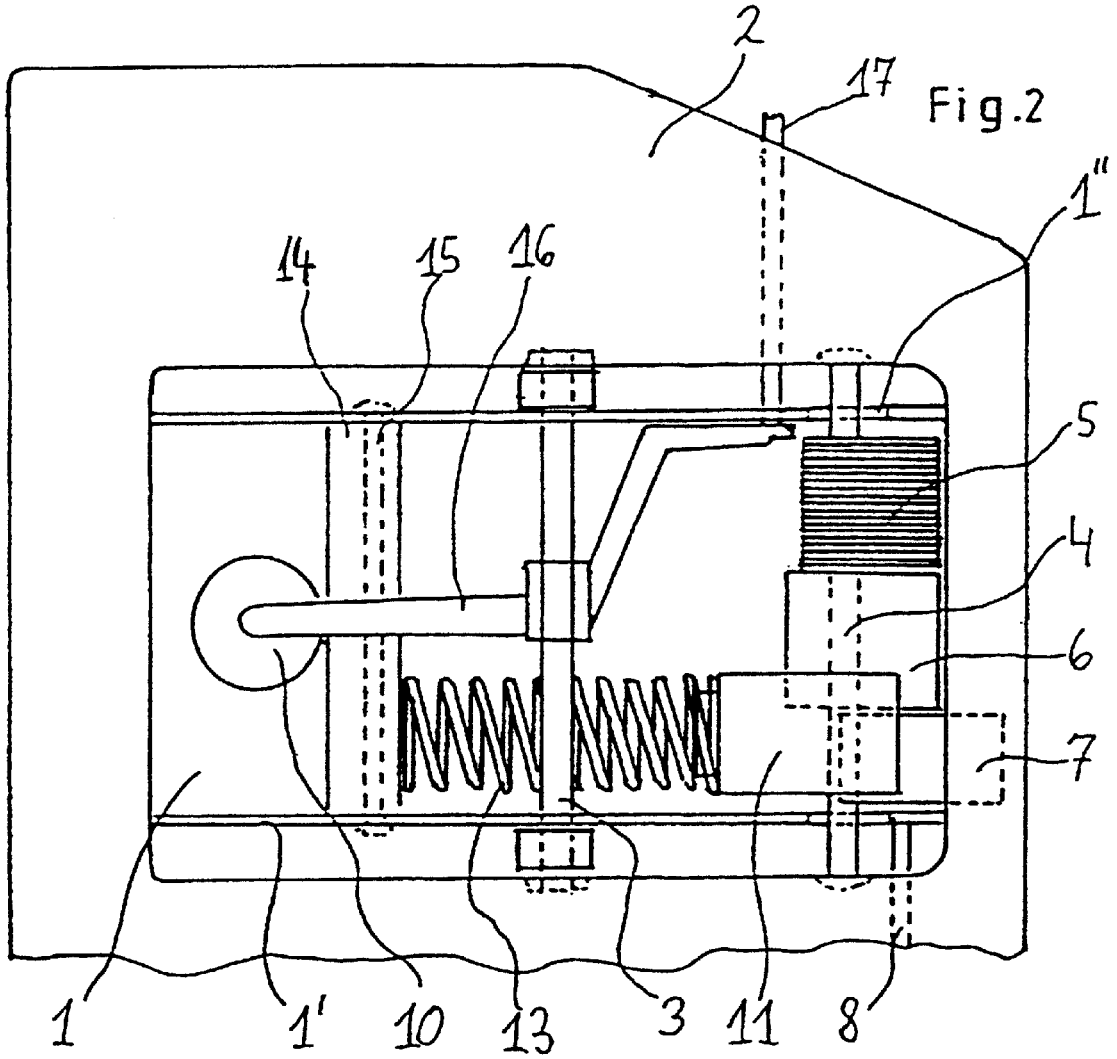
FIG. 2 is a partially cut-away plan view of the seat carrier of FIG. 1.

Referring to FIGS. 1 and 2, a seat carrier has a base part 1 and a seat platform carrier 2. A back rest carrier (not shown in the figures) connects to one of base part 1 and seat platform carrier 2. Seat platform carrier 2 is optionally designed with the back rest carrier integrally formed as a one-piece unit.

Base part 1 connects in a conventional matter through a conical bushing 10 to an upper end of a height adjusting support column (not shown in the figures). The support column can be any one of conventional height adjusting means, such as a gas spring. The opposite end of the support column connects to a conventional base (not shown in the figure).

Base part 1, having generally a U-shaped cross-section, has a bottom and two side walls 1'. Seat platform carrier 2 is a substantially flat member having a central open space at the sides where flaps 2' extend downward toward base part 1. Flaps 2' partially overlap side walls 1'.

A pin 3, arranged transverse to the longitudinal direction of seat platform carrier 2, is mounted in lateral flaps 2'. Pin 3 extends through holes in side walls 1' of base part 1 such that seat platform carrier 2 rocks about an axis of pin 3 relative to base part 1.

In front of pin 3 (to the right in FIG. 1), a horizontal retaining pin 4 extends through openings 1" in side walls 1' of base part 1. Horizontal retaining pin 4 attaches to seat platform carrier 2, between flaps 2'. This structure permits horizontal retaining pin 4 to transverse the longitudinal direction of seat platform carrier 2 without any direct contact between horizontal retaining pin 4 and base part 4.

An aligning pawl 11 is pivotably mounted on horizontal retaining pin 4. Aligning pawl 11 extends diagonally backwards towards the bottom of base part 1. A compression spring 13 is attached to the lower end of aligning pawl 11. A bearing support 14 in base part 1 supports the end of compression spring 13 opposite aligning pawl 11. Bearing support 14 is held in base part 1 by a fastening pin 15 mounted in side walls 1' of base part 1.

Compression spring 13 presses aligning pawl 11 forward. In a neutral or initial position as shown in the figures, aligning pawl 11 is supported between compression spring 13 and a link pin 12 mounted horizontally between side walls 1' of base part 1. Link pin 12 fits into the apex of a generally V-shaped aligning link 11'. Aligning link 11 abuts aligning pawl 11, facing away from compression spring 13.

If a force greater than that of compression spring 13 is applied on a front or a back surface of seat platform carrier 2 during its rocking function, a top part of aligning pawl 11 is either pushed downward or pulled upward. This results in one of the legs of aligning link 11' sliding along link pin 12. Aligning pawl 11 is always pressing backwards (to the left in the FIG. 1) against compression spring 13. In this manner, force is applied at the same time as the rocking motion of seat platform carrier 2 against base part 1. If the applied force is removed, compression spring, 13 pushes aligning pawl forward so that the apex of aligning link 11' abuts on link 12. This resumes the initial position between base part 1 and seat platform carrier 2 as shown in FIG. 1.

Compression spring 13 and the resetting means are arranged in a longitudinal direction on one side of the space enclosed by base part 1. On the other side of this space, conventional means for height adjustment and for fixing the seat carrier in a certain position are arranged. An actuator lever 16 is pivotably arranged on pin 3. A first end of actuator lever 16, extending beyond conical bushing 10, activates a height adjustment of the support column. The other end of actuator lever 16 extends forward to connect with a release lever 17, protruding from base part 1.

The clamping mechanism consists of a lamellar pack 5 pivotably linked at its upper end to retaining pin 4. The other end of lamellar pack 5 has oblong holes through which is slides up and down on a horizontal clamping pin 18. Claiming pin 18 is mounted in front between side walls 1' of base part 1. A clamping part 7, or eccentric cross-section, activated by a hand lever 8, can be pressed upon a pressure element 6. Pressure element 6 in turn compresses lamellar pack 5. The clamping and frictional force exerted on lamellar pack 5 holds lamellar pack 5 in a desired position corresponding to a certain incline between seat platform carrier 2 and base part 1. The clamping effect is released when hand lever 8 is operated in an opposite manner.

While a particular locking means is described above, the invention is not limited to that particular embodiment. Any known locking means can be used in the present invention.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A seat carrier for a chair comprising:

a base part;

a seat platform carrier;

downward flaps located at opposite ends of said seat platform carrier;

said downward flaps at least partially overlapping side walls of said base part;

connecting means for pivotably connecting said seat platform carrier to said base part;

said connecting means including a pin horizontally transversing said base part located a prscribed distance from a front end and a back end of said base part;

said pin extending through said flaps and said side walls;

said prescribed distance being at least ¼ of a length of said seat platform carrier;

said connecting means permitting said seat platform carrier to tilt forward and backwards about said pin relative to said base part;

resetting, means for returning said seat platform carrier from a tilting position, when a load is applied to said seat platform carrier, to an original initial position when said load is removed;

a retaining pin extending substantially parallel to said pin;

said retaining pin attached at each end to said downward flaps;

an aligning pawl extending diagonally in said base part attached at one end to said retaining pin;

a compression spring attached at one end to said base part; and said compression spring attached at the other end to an end opposite said one end attached to said retaining pin, such that when said load is applied to said seat platform carrier, said compression spring provides a resilient force through said aligning pawl to said seat platform carrier.

2. A seat carrier for a chair according to claim 1, further comprising:

an aligning link formed as a notch in said aligning pawl;

said notch positioned opposite to a position where said compression spring provides a resilient force to said aligning pawl;

a link pin attached to said base part; and said link pin fitting into said notch when said seat platform carrier is in its initial, load-free position.

3. A seat carrier for a chair according to claim 1, further comprising:

a lamellar pack pivotably attached at one end to said retaining pin;

said lamellar pack having oblong holes at the other end;

a clamping pin mounted between said side walls of said base part; and said clamping pin positioned through said oblong holes such that said lamellar pack is permitted to slide on said clamping pin, thereby providing a relative tilting motion between said seat platform carrier and said base part.

4. A seat carrier for a chair according to claim 3, further comprising:

a clamping means for locking said lamellar pack, thereby restricting said relative tilting motion; and a first hand lever extending outside said base part providing external activation and deactivation of said clamping means.

5. A seat carrier for a chair according to claim 1, further comprising:

height adjusting means for adjusting a vertical position of said seat carrier relative to a base of said chair; and a second hand lever extending outside said base part providing external activation and deactivation of said height adjusting means.

6. A seat carrier for a chair according to claim 5, wherein:

said height adjusting means includes an actuator lever pivotably mounted on said pin; and said second hand lever attached to said actuator lever, whereby a user is capable of selecting an appropriate seat height.

7. A seat carrier for a chair comprising:

a base part;

a seat platform carrier;

a pin horizontally transversing said base part located a prescribed length from a front end and a back end of said base part;

said prescribed distance being at least ¼ of a length of said seat platform carrier;

said pin permitting said seat platform carrier to tilt forward and backwards relative to said base part;

downward flaps located at opposite ends of said seat platform carrier partially overlapping side walls of said base part;

said pin extending through said flaps and said side walls;

a retaining pin extending substantially parallel to said pin attached at each end to said downward flaps;

an aligning pawl extending diagonally in said base part attached at one end to said retaining pin; and a compression spring attached at one end to said base part and at the other end to the other end of said aligning pawl such that when a load is applied to said seat platform carrier, said compression spring provides a resilient force through said aligning pawl to said seat platform carrier.

8. A seat carrier for a chair according to claim 7, further comprising:

an aligning link formed as a notch in said aligning pawl;

said notch positioned opposite to a position where said compression spring provides a resilient force to said aligning pawl;

a link pin attached to said base part; and said link pin fitting into said notch when said seat platform carrier is in its initial, load-free position.

9. A seat carrier for a chair according to claim 7, further comprising:

a lamellar pack pivotably attached at one end to said retaining pin;

said lamellar pack having oblong holes at the other end;

a clamping pin mounted between said side walls of said base part; and said clamping pin positioned through said oblong holes such that said lamellar pack is permitted to slide on said clamping pin, thereby providing a relative tilting motion between said seat platform carrier and said base part.

10. A seat carrier for a chair according to claim 9, further comprising:

a clamping means for locking said lamellar pack, thereby restricting said relative tilting motion; and a first hand lever extending outside said base part providing external activation and deactivation of said clamping means.

11. A seat carrier for a chair according to claim 7, further comprising:

height adjusting means for adjusting a vertical position of said seat carrier relative to a base of said chair; and a second hand lever extending outside said base part providing external activation and deactivation of said height adjusting means.

12. A seat carrier for a chair according to claim 11, wherein:

said height adjusting means includes an actuator lever pivotably mounted on said pin; and said second hand lever attached to said actuator lever, whereby a user is capable of selecting an appropriate seat height.

* * * * *